US006604246B1

(12) United States Patent
Obreja

(10) Patent No.: US 6,604,246 B1
(45) Date of Patent: Aug. 12, 2003

(54) PROTECTIVE HELMET

(76) Inventor: Catalin Obreja, 211 rue Robespierre, 93 170 Bagnolet (FR)

( * ) Notice: Subject to any disclaimer, the term of this patent is extended or adjusted under 35 U.S.C. 154(b) by 0 days.

(21) Appl. No.: 09/857,828

(22) PCT Filed: Dec. 7, 1999

(86) PCT No.: PCT/FR99/03035

§ 371 (c)(1),
(2), (4) Date: Jun. 7, 2001

(87) PCT Pub. No.: WO00/33689

PCT Pub. Date: Jun. 15, 2000

(30) Foreign Application Priority Data

| | | |
|---|---|---|
| Dec. 7, 1998 | (FR) | 98 15393 |
| Jul. 2, 1999 | (FR) | 99 08536 |
| Oct. 4, 1999 | (FR) | 99 12345 |

(51) Int. Cl.[7] ..... A42B 3/00
(52) U.S. Cl. ..... 2/411; 2/412

(58) Field of Search ..... 2/410, 425, 411, 2/412, 414

(56) References Cited

U.S. PATENT DOCUMENTS

| | | | | | |
|---|---|---|---|---|---|
| 3,462,763 | A | * | 8/1969 | Schneider et al. | 2/413 |
| 4,665,569 | A | * | 5/1987 | Santini | 2/425 |
| 5,309,576 | A | * | 5/1994 | Broersma | 2/412 |
| 5,669,079 | A | * | 9/1997 | Morgan | 2/412 |
| 5,930,841 | A | * | 8/1999 | Lampe et al. | 2/411 |
| 5,950,244 | A | * | 9/1999 | Fournier et al. | 2/411 |

FOREIGN PATENT DOCUMENTS

| | | | |
|---|---|---|---|
| FR | 2557437 | * | 7/1985 |

* cited by examiner

*Primary Examiner*—Rodney M. Lindsey

(57) ABSTRACT

The invention concerns a cranio-cerebral protective helmet adapted to the anatomy of the head and to the neurosurgical knowledge. The helmet is adapted to the resistance of different regions of the skull vault thereby reducing cranio-cerebral lesions and post traumatic neurological disorders.

18 Claims, 3 Drawing Sheets

PROTECTIVE HELMET

BACKGROUND OF THE INVENTION

1. Technical Field

The invention concerns a cranio-cerebral protective helmet adapted to the anatomy of the head and to the neurosurgical knowledge.

2. Background Art

The cranium comprises two portions: the neuro-cranium which contains the brain and the viscero-cranium which represents the skeleton of the face. The present invention mainly concerns the part of the helmet covering the neurocranium.

Protective helmets have:

A. two components which must answer to biomechanical safety requirements:
   1. an external shell—hereafter called"the shell"—which ensures, during an impact, the distribution of the delivered energy to a surface larger than the surface interested by the external shock. It also ensures an increased resistance to the penetration of the helmet and the sliding of the helmet on different surfaces in case of accident;
   2. an intermediate cap—hereafter called"the cap"—intended for the energy absorption by its compressive crush during an impact;

B. an internal component also called comfort stuffing, dedicated to improve the user's comfort.

Certain helmets also have intermediate shells. The term-"shell" as used in this description corresponds to the external shell as well as to any other intermediate shell.

In the case of the helmets for motorcyclists' (or similar) application, by the use of increasingly resistant materials, the shell distributes on the surface and transmits to the intermediate cap almost all the received energy, even in the case of an impact with high neurological risk (INR). In the case of the helmets for cyclists (or similar), by the use of very flexible/soft materials, the shell does not ensure, or practically not, any biomechanical function. In all the cases, after the partial absorption of energy by the intermediate cap, the residual kinetic energy is transmitted to the cranium and finally to the brain. The immediate neurological disorders which may result are more serious if the energy transmitted to the brain is higher. By "INR" is meant impacts which expose the subject to neurological disorders (transitory or persistent) in spite of the usage of a helmet designed in the state of the art.

The conception of the current helmets encounters several problems:

How to increase their effectiveness without increasing their thickness and their volume beyond the acceptable limits? Beside the lack of comfort and the tiredness of the neck muscles, the volume increase may cause accidents itself by the reduction of the surrounding visual and hearing perception. In the mean time, the exaggerated increase of the helmets' volume and/or weight can easily slow down their usage.

When to protect the head better: in violent impacts (rare) or in moderate impacts (frequent)? Corner (1987), Mills (1991), Smith (1993) showed that if the current helmets are designed for better deadening the violent impacts, they will be hard and less effective in the event of a mild energy impact.

Another disadvantage of the current helmets is related to the fact that the hardness of their cap is not adapted to the resistance of the various areas of the cranium. In particular, the resistance of the cranium varies a lot from one area to another because of the differences in thickness of the cranium (less than 2 millimeters in the anterior temporal area, almost 10 millimeters in the parietal area); the various curvature radii of the skull vault; and the presence of the cranial sutures.

SUMMARY OF THE INVENTION

The invention provides for the reduction of the cranio-cerebral lesions and the post traumatic neurological disorders by an important energy absorption in the event of a violent impact, through the deformation or the fracture of the helmet's shell in front of the zones of maximum resistance of the cranium and by a better protection of the cranium due to an intermediate cap having a variable hardness or density adapted to resistance of the various areas of the skull vault.

Both the shell and the cap of the helmet herein described contribute to solve these problems.

The shell of the helmet herein described has the capacity to undergo deformations or fractures preferably in front of the areas of maximum resistance of human cranium, in the event of INR. The energy thus absorbed or consumed ensures the reduction of the energy transferred to the head and to the cervical spine also. The risks of post-traumatic tetraplegia secondary to a fracture of the cervical spine will thus also decrease. The deformations or the fractures occur in areas of the shell containing low mechanical resistance layers (LRL) or low mechanical resistance zones (LRZ). In a low energy impact, the shell according to the invention functions on the same principle as the shell of the current motorcycle helmets. From this point of view the LRZ and the LRL act as the"relief valves" of the pressure containers.

For obtaining a differentiated pressure repartition on the fragile and resistant zones of the cranium during an impact, the cap of the helmet herein described has a density or a hardness variable and adapted to the resistance of the different areas of the skull vault. Thus the helmet herein described comprises a cap with zones of low compressive-crushing resistance—soft—in front of the fragile zones of the human cranium, and zones of high compressive-crushing resistance—hard—in front of the zones of maximum resistance of the human cranium. Through this logical distribution of the hard and soft zones of the cap, one obtains a more effective helmet in comparison with ones currently available, but having a similar volume and weight.

The deformation or the fracture of the shell has important biomechanical consequences:

1. the (t) duration of the impact increases.
2. the kinetic energy ($EC=mV^2/2$) received by the head (Ec3) decreases since the energy absorbed by the helmet ($\Delta E1+\Delta E2$) increases.

Ec1=kinetic energy of the ensemble before the impact $\Delta E1$=energy absorbed by the shell $\Delta E2$=energy absorbed by the cap $Ec3=Ec1-(\Delta E1+\Delta E2)$ The average acceleration (a) decreases because Ec3 decreases and T increases.

$$(a=V/t=(2\times Ec3/m)^{1/2}/t).$$

The Head Injury Criterion (HIC), used to evaluate the damping of the normative impacts, is expressed in its simplified form:

$$HIC=dV^{2.5}/dt^{1.5}=(dV^2/dt)(dV/dt)^{1/2}$$

It is proportional to the kinetic energy ($dV^2$) and inversely proportional to the duration of the energy transfer during the impact (dt). For the reasons already exposed, it will decrease; thus presenting a better damping of the shocks.

The embodiments presented below are only given as examples and are not restrictive. Various combinations between the different embodiments disclosed and their alternatives are also considered.

DETAILED DESCRIPTION OF THE INVENTION

Figure 1:
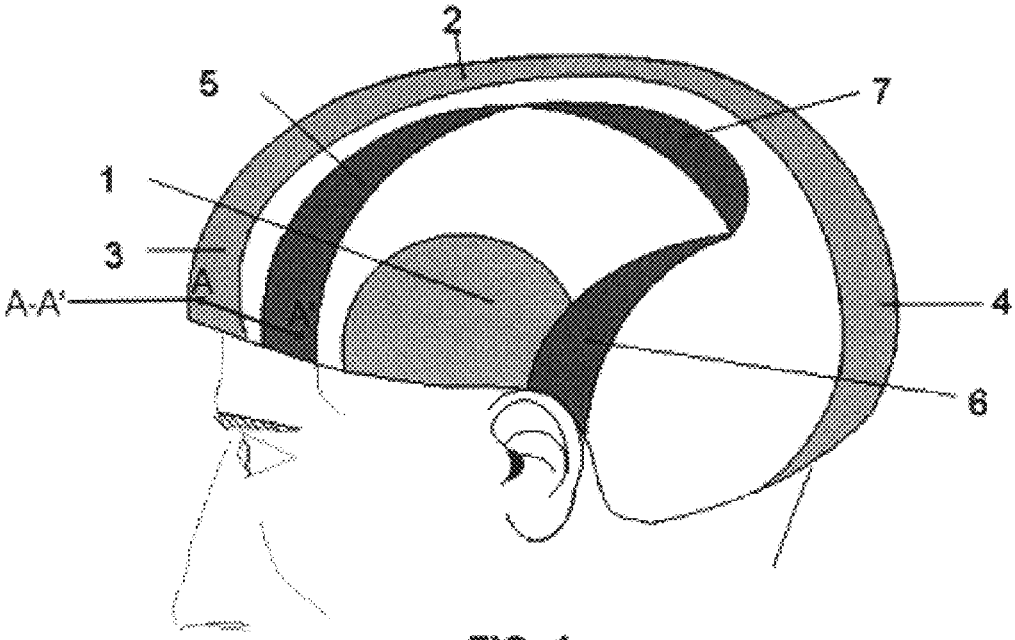
FIG. 1 presents a left side view of the portion corresponding to the skull vault of a variant of protective helmet. The fragile zones of the cranium are represented by the antero-temporal areas (1), the median line and the para-median areas (2), particularly frontal (3) and occipital (4). The zones of maximum resistance of the cranium are represented by the two fronto-lateral pillars (5), the two retro-auricular pillars (6) and the two parietal areas (7).

Concerning the shell of the helmet, two groups of practical solutions and some examples will be presented:

A. The fracture occurs by the tear of the low resistance zones (LRZ), preferably remotely from the point of impact.

B. The deformation occurs by the compressive crush of the low resistance layers (LRL), preferably in front of the impact point.

The LRZ are located in the thickness of the shell. The LRL are situated exteriorly to the thickness of the shell. The LRL can be laid out on one or on both surfaces (internal and external) of the shell.

The LRZ or LRL are preferably concentrated in front of at least two or four of the zones of maximum mechanical resistance of the human cranium. They will preferably lack from the median line and antero-temporal areas in order to decrease the injury risk of the superior longitudinal sinus and respectively that of the middle meningeal artery. By their location, these anatomical structures are particularly exposed to a high risk of bleeding in the case of cranium fractures occurring in their vicinity and at the same time these areas of the cranium are fragile.

The low resistance zones or layers may cover less than 20% of the total surface of the shell. Several LRZ or LRL can reach each other or can be located at less than 10 mm from one another or from any discontinuities such as the ventilation openings, or the fixing holes (chin strap, visor, etc.) and thus form a spatial low resistance grouping (SLRG). The LRZ or the LRL can reach or can be located at less than 5 mm from the edge of the shell (5, 6)—frontal (FES), lateral (LES) or posterior (PES).

The highest point of the shell, for a helmet positioned on the head, represents the center of the shell (CS). The large circumference of the shell covering the skull vault will be thereafter named"the large circumference of the shell" (LCS). Its direction is approximately horizontal. On the anterior side, it coincides with the frontal edge of shell (FES) as well for the full-face helmets as for the-other types of helmet and it is defined by the intersection between the plan containing the FES and the external surface of the shell.

A. The Low Resistance Zones (LRZ)

Each LRZ may have a point with a minimal resistance to tearing or shearing. This point will be hereafter named"the point of minimal resistance" (PmR) of the LRZ. The PmR of any LRZ will be preferably located in the furthest third part of the LRZ from the CS. Each LRZ has, due to its conformation, a direction of minimal resistance which corresponds to the direction of the shell fracture occurring in the event of an INR. This direction will be named hereafter"the direction of minimal resistance" (DmR) of the LRZ. The size of the angle between the DmR and the LCS is preferably between 60° and 120°.

The surface dimensions of the LRZ are variable. The maximum surface diameter—the length—can be at least 20 times superior to their minimal diameter—the width. The DmR of a LRZ often corresponds to its own length. Thus the angle between the length of the LRZ and the LCS is preferably between 60° and 120°.

Figure 2:
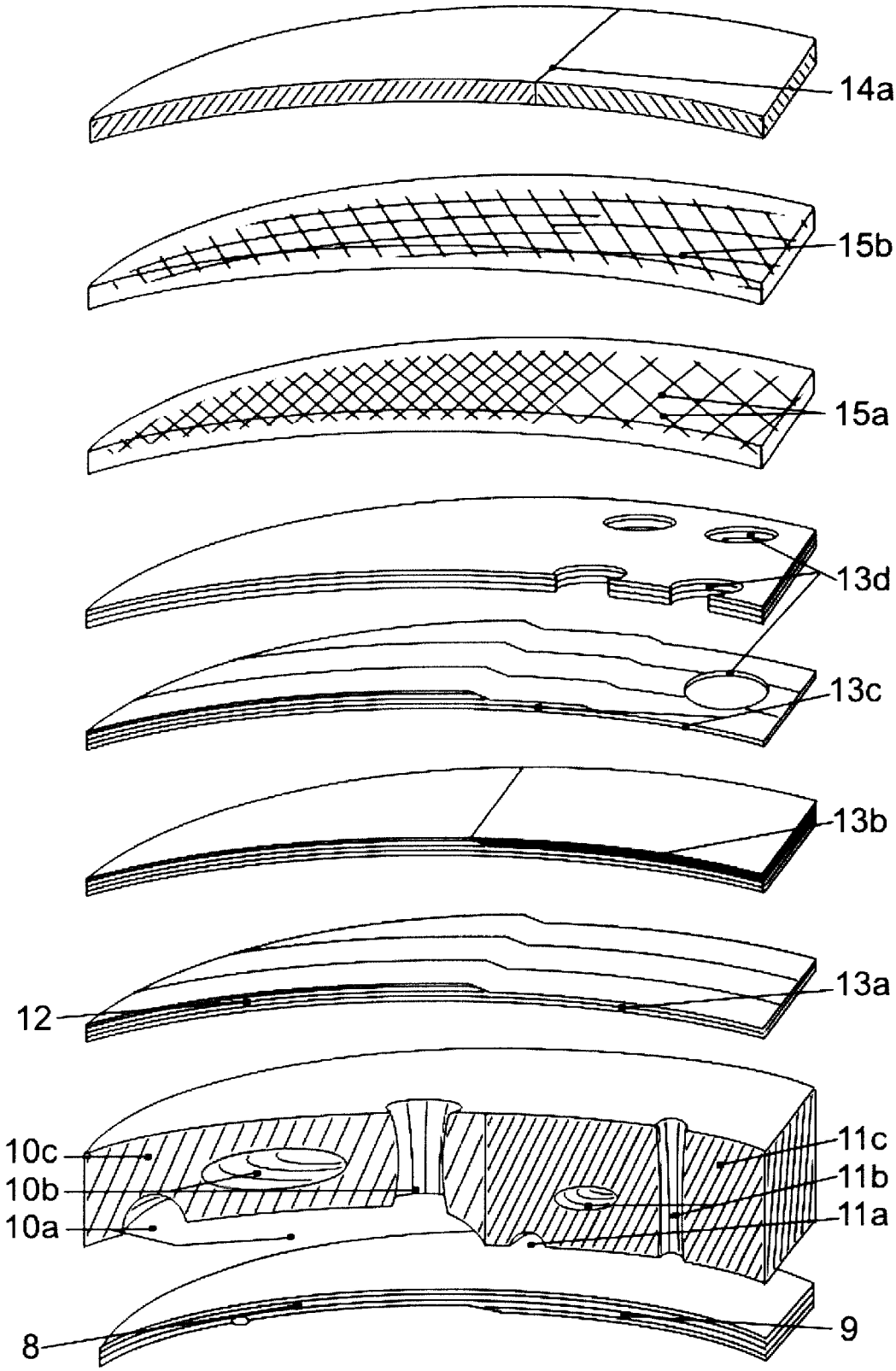
FIGS. 2 and 3 are enlarged sectional views taken through various cap and shell embodiments having various zones and/ or layers adapted to be located in front of the fragile (8) and the maximum resistant zones (9) of the cranium of the wearer.

In one variant, the LRZ can be obtained by the reduction of the thickness of the shell describing depressions or furrows (13*a*) (FIG. 2) on at least one of the shell's surfaces (external or internal). Their depth and their surface can vary (13*c*) or gradually vary. The dimensions of the depressions or furrows measured on the surface, on sections parallel with the edge of the shell can vary gradually. Their depth can exceed, at least at some locations, 50% of the shell thickness measured in the proximity of the LRZ (12) on a section parallel with the edge of the helmet.

Their depth may comprise, at least at some locations, 100% of the shell thickness and thus generate discontinuities (DC) of the shell (13*d*). The length of the DC can be at least 20 times superior to their width. Their length can exceed 70 mm. The length of the DC measured on any direction which passes through the center of the shell can be less than 7 mm, particularly for the DC in contact with, or at less than 5 mm from, the edge of the shell (FES, LES or PES) or at less than 10 mm from other DC of the shell (such as the ventilation openings or the fixing holes) or other zones or layers of low resistance. At least one diameter of the DC may be less than 3 mm.

In another variant, the LRZ can be obtained by including, into the thickness of the shell, bubbles of gas or other structures made of a material different or similar to the material employed for the rest of the shell. In the case of a solid material, the inclusion can also be situated on at least one of the surfaces of the shell. This situation corresponds to a furrow, a depression, or a DC filled with the chosen material. Thus, the lack of substance in the thickness of the shell can be occupied, at least partially, by metal inclusions having their zones of less than 80% of the shell thickness, at least partially covered towards the two surfaces of the shell by the principal component of the shell.

One of these variants is represented by the inclusion in the thickness of the shell of the flattened structures of variable shape, having a high rigidity, hardness and mechanical resistance (13*b*). They can be made out of metal structures or other materials like resins, polymers or composite materials. Contrary to the composite materials, when resistant fibers are used to reinforce the tear strength of the shell, a case described later on, the usage of the solid structures here described decreases the tear strength, thus allowing, during violent impacts, the occurrence of the fractures generated at some distance from the impact point and having an optimal direction. In the meantime, they increase the resistance of these zones to the direct impacts.

The thickness of such a structure is variable and preferably measures between 0.5 and 3 mm. It can also be equal, at least at some locations, to the thickness of the shell but, preferably, does not exceed it. The surface of the shell corresponding to such a structure is variable and will preferably be between 0.3 and 5 $cm^2$. The surface of the shell segments containing such structures can represent less than 10% of the total surface of the shell.

These structures can measure between 1 and 3 $mm^2$ on at least two sections perpendicular to their length and being located at more than 10 mm between them. They can have an oval or polygonal shape on their section. Preferably, they are made of metal and they have a shape of an isosceles triangle on their surface, with a thicker base situated parallel to the maximum perimeter of the shell, in contact or located at less than 5 mm from the edge of the shell.

In another variant, for the shells constructed of composite materials, the LRZ can also be obtained by the modification of the density or of the orientation of the employed fibers (carbon, glass, aramide, metal) before the injection of the resin or of the polymer in the mold. The low resistance zones can be obtained by the reduction of at least 50% of the fiber density as compared to the areas situated near the LRZ (15*a*). In another variant, the low resistance zones are obtained by the reduction of at least 30% or 50% of the density of the non-radial long fibers as compared to the density of the parallel fibers situated in areas close from the LRZ (15*b*). The non-radial fibers are those fibers having directions crossing the LCS with angles of less than 70° or more than 110° (15*b*).

The long fibers are those fibers which go beyond the limits of the LRZ on at least 10 mm.

Another variant consists in the interruption of more than 50% of the long fibers which cross the direction of minimal resistance describing any angle, or preferably an angle between 30°–150°. The reduction of the density of the long fibers can be of at least 50% compared to the parallel fibers, or describing angles lower than 10° with their directions, and located in zones situated near the LRZ. In these LRZ, the long fibers which cross the direction of minimal resistance under any angle can be absent or can be interrupted by cutting. In another alternative, additional layers of fibers crossing the direction of minimal resistance of the LRZ are added near the LRZ before the injection of the polymer or the resin.

Another variant consists of inclusion of additional fiber beams in the zones situated close to the LRZ, describing angles of 30°–150° with the length of the LRZ. Another alternative for obtaining the LRZ consists of disposing more than 75% of fibers contained in the LRZ, parallel with the direction of minimal resistance or the length of the LRZ.

The low resistance zones can also consist of several orifices (13*d*) located at less than 10 mm between them.

In another variant the shell can be made out of segments. The segments can be unified towards the center of the shell and thus realize, from the beginning, one single polygonal part. The number of segments that have to be at least partially assembled vary and will preferably be between 2 and 5. The segments are assembled while obtaining LRZ at the junctions (14*a*). The tear strength of these junctions can vary and preferably represents between 30% and 70% of the tear strength of the segments of shell closely situated. Stamping, hot joining, the use of the adhesive substances or the joining of the structures with hooks at least partially removable and adjustable are considered. The structures with hooks can be partially removable, fixed on one of the segments to assemble, adjustable, and thus form"bracelet" structures. They can be manufactured at the same time as the rest of the shell or they can be added on later by any technical procedure (stamping, joining, partial or complete piercing of the shell thickness). The structures with hooks can be detachable from the two segments to assemble and thus form "bridging" structures. The structures with hooks can be laid out on only one surface of the shell, preferably on the internal surface. This alternative is particularly adapted to the situation when the segments are unified towards the center of the shell. In another alternative, the structures with hooks can be laid out on both surfaces of the shell. By their alternative joining (external—internal in section, right—left on the surface) they ensure the solidity of the unit.

In other variants, the relative low resistance zones of the shell are obtained by the reinforcement of the zones of the shell located in front of the fragile zones of the cranium.

Figure 3:
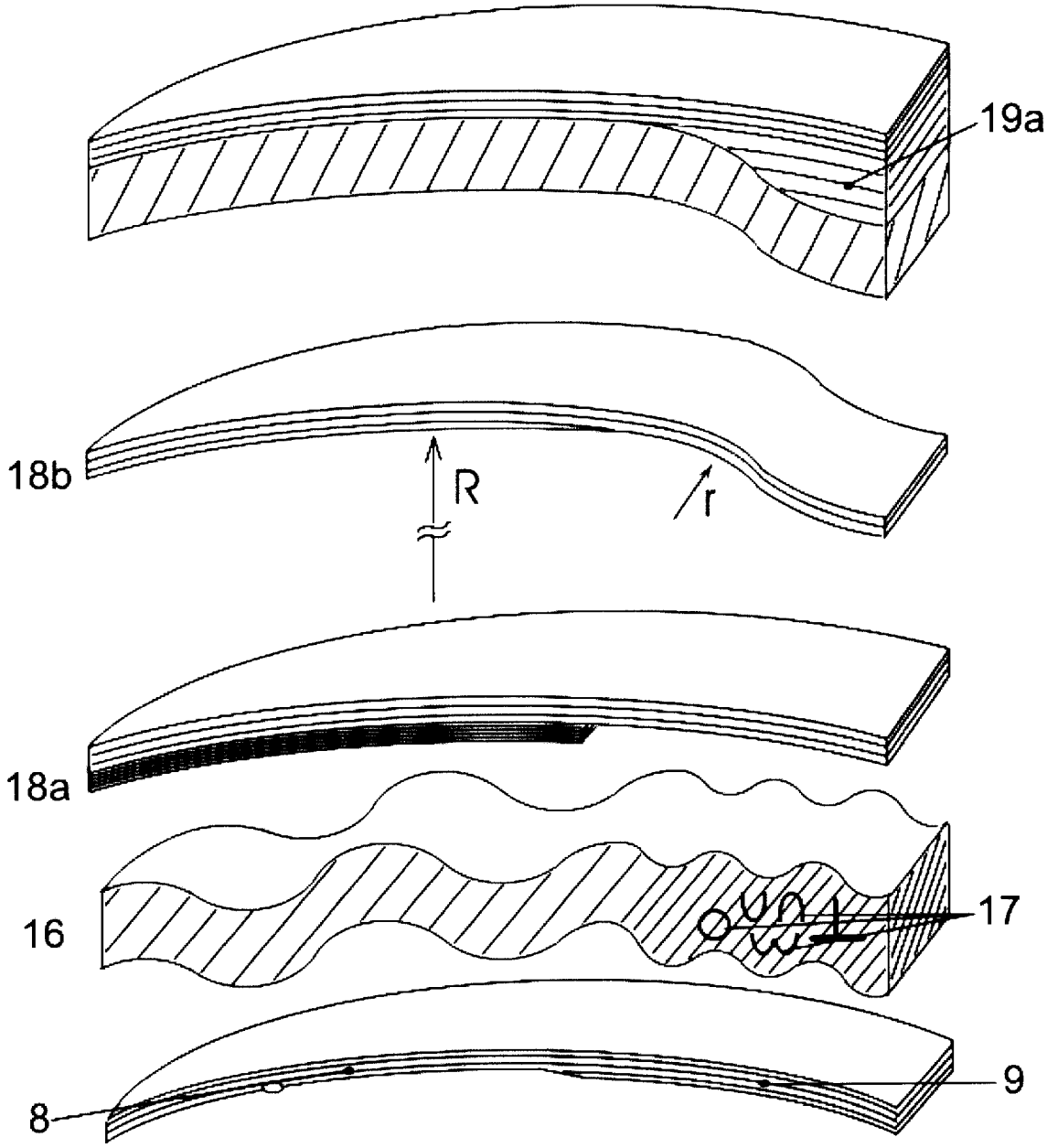

The reinforcement of the shell in front of the fragile zones of the cranium can be obtained by using rigid and resistant structures made out of metal, plastic, composites or other materials (18*a*) (FIG. 3).

The reinforcement of the shell in front of the fragile zones of the cranium can be obtained by the reduction, progressive or not, of the curvature radius of the shell towards any discontinuity located in the reinforced zones of the shell and towards the periphery of the reinforced zones (18*b–r*), with construction of shell depressions (18*b*) concentrated in front of the resistant zones of the cranium and measuring more than 5 mm.

The shell of the helmet can also have discontinuities with their length at least 20 times bigger than their width.

B. The Low Resistance Layers (LRL)

As shown in FIG. 3, the structure of the LRL can be compact (19*a*) or alveolar. They can be constructed at the same time as the rest of the shell or they can be secondarily fixed to the surface of a shell constructed in the state of the art. In this second alternative, the low resistance layers can be applied directly in contact with the shell or by at least one interposed energy absorbing structure.

The LRL can be obtained by folded structures:U-shaped, M-shaped, each one having several contacts with the shell on a sectional view, or T-shaped, L-shaped, each one having only one contact with the shell on a sectional view. The thickness of the employed materials may vary and may be less than 75% of the thickness of the shell closely situated. The thickness of the LRL can exceed 5 mm or even 10 mm. The surface of the shell covered by each LRL may vary between 0.5 $cm^2$ and 30 $cm^2$. At least two thirds of the LRL may have surfaces between 3 $cm^2$ and 15 $cm^2$.

Materials that are identical, similar with or different from the rest of the shell, can be employed for their construction. They will preferably be identical with the polymer or the resin used for the rest of the shell. The LRL can thus be manufactured at the same time as the rest of the shell by the modification of the injection mold. In another variant they can be manufactured separately.

The LRL can also have hooks fixed to the shell.

The LRL can be situated in contact with the external or internal surface of the shell (19*a*), or remotely situated from the shell, in the thickness of the intermediate cap (17). In the last exposed variant, the LRL can get in contact with the shell during a violent impact, after the compressive crush of the intermediate cap between the shell and the head.

The LRL of the shell included in the thickness of the cap (17, 19*a*) increase the compressive crushing resistance in these areas of the cap because their hardness or density is higher than the hardness or the density of the cap.

In another variant of the invention, the functions of the LRL of the shell included in the thickness of the cap can be provided by the cap itself, which has zones of high compressive crushing resistance—hard (11*c*)—in front of the zones of maximum resistance of the cranium (9) and zones of low compressive crushing resistance—soft (10*c*)—in front of the fragile zones of the human cranium (8).

A first group of technical solutions concerns the increase of the cap hardness or density in front of the zones of maximum resistance of the cranium and the employment of various structures harder than the basic material of the cap, located in the thickness of the cap or beyond its thickness, on its external surface and in the vicinity of the shell or on its internal surface and in the vicinity of the head, attached to or being part of the shell or respectively of the comfort stuffing. These hard structures can absorb more energy by their compressive crush than the basic material of the cap. Thus, the term of cap used in this description corresponds to all structures of the helmet which are intended for the energy absorption by their compressive crush in case of impact, and not only to the intermediate cap as in the traditional sense of the term.

As a nonrestrictive example, the increase of the compressive crushing resistance in front of the zones of maximal resistance of the cranium can be obtained through:

The modification of the density of the same material or the employment of expanded materials with different hardness.

Thus, the cap located in front of the zones of maximum resistance of the human cranium can have, on at least the exterior quarter of its thickness, a density or a hardness at least 40% higher than the density or the hardness of the remainder of the cap.

In another variant, the cap located in front of the zones of maximum resistance of the human cranium has, on at least the exterior quarter of its thickness, a density or a hardness at least 60% higher than the density or the hardness of the internal part of the cap located in front of the fragile zones of the cranium.

In another alternative, the cap located in front of the zones of maximum resistance of the human cranium has, on at least the exterior half of its thickness, a density or a hardness at least 100% higher than the density or the hardness of the internal part of the cap located in front of the fragile zones of the human cranium.

If the cap comprises segments made of the same material with different densities, the notion of hardness superposes to the notion of density. In the contrary situation or if inclusions are used as described below, the notion of hardness corresponds better to the results sought by this invention than the notion of density.

The inclusion of the structures (17) (FIG. 3) deformable in violent impacts, made of plastic material, glass, metal or others, having a hardness higher than that of the basic material of the cap, at least partially included in the thickness of the cap (19*a*).

These structures can have different shapes (spherical, in cupola, U-shaped, T-shaped, M-shaped) and can have at least one dimension superior to 5 mm. The hardness of these structures is preferably at least 50% higher than that of the basic material of the cap. These structures are concentrated in front of the zones of maximum resistance of the human cranium.

In one variant, the density of the inclusions located in the exterior half of the cap situated in front of the zones of maximum resistance of the human cranium is at least twice higher than the density of the inclusions located in the internal half of the cap situated in front of the fragile zones of the human cranium.

In a second group of technical solutions, the present invention concerns the reduction of the compressive crushing resistance of the cap situated in front of the fragile zones of the cranium. As a non-restrictive example, the reduction of the crushing resistance in front of the fragile zones of the cranium can be obtained by the adequate distribution of furrows situated on at least one of the cap surfaces, or of cavities located in the cap thickness. Thus the cap located in front of the fragile zones of the human cranium (8) has furrows on at least one of its surfaces (10*a*), or cavities in its thickness (10*b*), and these furrows or cavities are smaller (11*a*, 11*b*) or absent in front of the zones of maximal resistance of the human cranium (9). The furrows can generate a corrugated aspect of the cap on at least one section perpendicular to the cranium (16).

In one variant the volume of the furrows or of the cavities comprises, in front of the fragile zones of the human cranium, more than 20% of the volume delimited between the head and the external shell of the helmet and, in front of the zones of maximum resistance of the human cranium, less than 20% of the volume delimited between the head and the external shell of the helmet.

In another variant the volume of the furrows or cavities of the cap comprises—in front of the fragile zones of the cranium—between 50% and 100% of the volume delimited between the head and the external shell of the helmet.

As a nonrestrictive example, the cap of the helmet herein described can be constructed of expanded polystyrene, expanded polyethylene, expanded polypropylene, polyurethane foam or another products and any combination thereof.

The inventive helmet can be full-face or open-face and is particularly designed for civilians (motorcycles: for tests, racing competitions and everyday use; cars: for tests and racing competitions; bicycles: for racing competitions and everyday use; other sports: roller skating, skateboard riding, winter sports; and in industrial surroundings).

What is claimed is:

1. A cranio-cerebral protective helmet, comprising:

(a) a cap comprising:

first zones of low compressive crushing resistance adapted to be located in front of the fragile zones of the cranium of the wearer, the first zones being formed by at least one of: furrows on at least one surface of the cap, cavities in a thickness of the cap, and soft zones; and second zones of high compressive crushing resistance adapted to be located in front of the zones of maximum resistance of the cranium of the wearer, the second zones being formed by at least one of: smaller furrows, smaller cavities, and harder zones; and (b) a shell comprising at least one of:

low resistance zones adapted to be located in front of at least two of the maximum resistant zones of the cranium of the wearer, the low resistance zones being situated in a thickness of the shell and being formed by at least one of:

(i) a reduction of the shell thickness and construction of depressions and furrows;

(ii) orifices;

(iii) junctions between sectors of the shell; and (iv) a modification of at least one of: a fiber density and an orientation in a case of a shell constructed of composite materials;

low resistance layers adapted to be located in front of at least two of the maximum resistant zones of the cranium of the wearer, the low resistance layers being situated on at least one of an internal shell surface and an external shell surface, and being formed by at least one of compact structures and alveolar structures; and reinforced zones adapted to be located in front of the fragile zones of the cranium of the wearer, the reinforced zones being formed by at least one of: rigid and resistant structures, and a reduction of a curvature radius of the shell towards the periphery of the reinforced zones.

2. The helmet of claim 1, wherein at least one of the furrows and the cavities of the cap have a volume comprising:

more than 20% of a volume delimited between the wearer's head and an external helmet shell in zones adapted to be in front of the fragile zones of the cranium; and less than 20% of a volume delimited between the wearer's head and an external helmet shell in zones adapted to be in front of the maximum resistance zones of the cranium.

3. The helmet of claim 2, wherein at least one of the furrows and the cavities of the cap have a volume comprising more than 50% of the volume delimited between the wearer's head and the external helmet shell in zones adapted to be in front of the fragile zones of the cranium.

4. The helmet of claim 1, wherein a conformation of the furrows of the cap comprises a corrugated aspect on at least one section adapted to be perpendicular to the wearer's cranium.

5. The helmet of claim 1, wherein the cap has, in portions adapted to be in front of the zones of maximum resistance of the wearer's cranium and on at least an exterior quarter of the thickness of the cap, at least one of a density and a hardness at least 40% higher than that of a remainder of the cap.

6. The helmet of claim 1, wherein the cap has, in portions adapted to be in front of the zones of maximum resistance of the wearer's cranium and on at least an exterior quarter of the thickness of the cap, at least one of a density and a hardness at least 60% higher than that of an internal part of the cap adapted to be situated in front of the fragile zones of the cranium of the wearer.

7. The helmet of claim 6, wherein the cap has, in portions adapted to be in front of the zones of maximum resistance of the wearer's cranium and on at least an exterior half of the thickness of the cap, at least one of a density and a hardness at least 100% higher than that of the internal part of the cap adapted to be situated in front of the fragile zones of the cranium of the wearer.

8. The helmet of claim 1, wherein the second zones of the cap are obtained by an inclusion of structures which are deformable in a case of a violent impact, the structures comprising elements having different geometric shapes and further having a hardness at least 50% higher than a hardness of a remainder of the cap.

9. The helmet of claim 1, wherein at least one of a depth of the shell depressions and a depth of the shell furrows vanes.

10. The helmet of claim 9, wherein at least one of the depth of the depressions and the depth of the furrows comprises, in some regions, 100% of the shell thickness, thus creating discontinuities in the shell.

11. The helmet of claim 1, wherein at least one of the shell furrows and the shell depressions is filled with structures comprising a different material from that used for a remainder of the shell.

12. The helmet of claim 1, wherein the shell comprises composite materials and the low resistance zones of the shell are created by a fiber density reduction of at least 50% in contrast with areas situated near the low resistance zones of the shell.

13. The helmet of claim 1, wherein the shell comprises composite materials and the low resistance zones of the shell are obtained by a reduction of at least 30% of a density of non-radial and long fibers in comparison with areas situated near the low resistance zones of the shell.

14. The helmet of claim 1, wherein the low resistance layers of the shell are included in the thickness of the cap.

15. The helmet of claim 1, wherein at least one of the low resistance shell layers and the low resistance shell zones are situated at less than 5 mm from an edge of the shell.

16. A cranio-cerebral protective helmet, comprising:

(a) a cap comprising:

first zones of low compressive crushing resistance adapted to be located in front of the fragile zones of the cranium of the wearer; and second zones of high compressive crushing resistance adapted to be located in front of the zones of maximum resistance of the cranium of the wearer; and (b) a shell comprising at least one of:

low resistance zones adapted to be located in front of at least two of the maximum resistant zones of the cranium of the wearer;

low resistance layers adapted to be located in front of at least two of the maximum resistant zones of the cranium of the wearer; and reinforced zones adapted to be located in front of the fragile zones of the cranium of the wearer.

17. A cranio-cerebral protective helmet, comprising a cap, the cap including:

first zones of low compressive crushing resistance adapted to be located in front of the fragile zones of the cranium of the wearer; and second zones of high compressive crushing resistance adapted to be located in front of the zones of maximum resistance of the cranium of the wearer.

18. The helmet of claim 17, further comprising a shell, the shell including at least one of:

low resistance zones adapted to be located in front of at least two of the maximum resistant zones of the cranium of the wearer;

low resistance layers adapted to be located in front of at least two of the maximum resistant zones of the cranium of the wearer; and reinforced zones adapted to be located in front of the fragile zones of the cranium of the wearer.

* * * * *